US010697209B2

(12) United States Patent
Kim et al.

(10) Patent No.: US 10,697,209 B2
(45) Date of Patent: Jun. 30, 2020

(54) CINCHING LATCH ASSEMBLY FOR VEHICLE

(71) Applicants: Hyundai Motor Company, Seoul (KR); Kia Motors Corporation, Seoul (KR); Pyeong Hwa Automotive Co., Ltd., Daegu (KR)

(72) Inventors: Sang Il Kim, Hwaseong-si (KR); Seong Geun Byeon, Daegu (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 513 days.

(21) Appl. No.: 15/340,820

(22) Filed: Nov. 1, 2016

(65) Prior Publication Data

US 2017/0306661 A1 Oct. 26, 2017

(30) Foreign Application Priority Data

Apr. 21, 2016 (KR) ..... 10-2016-0048530

(51) Int. Cl.
*E05B 81/20* (2014.01)
*E05B 81/16* (2014.01)
(Continued)

(52) U.S. Cl.
CPC ..... *E05B 81/20* (2013.01); *E05B 81/16* (2013.01); *E05B 83/24* (2013.01); *E05B 77/08* (2013.01);
(Continued)

(58) Field of Classification Search
CPC ..... E05B 81/20; E05B 81/16; E05B 83/24; E05B 77/08; E05B 77/10; E05B 77/12;
(Continued)

(56) References Cited

U.S. PATENT DOCUMENTS 4,961,601 A * 10/1990 Lindholm ..... E05B 83/16 292/216
5,048,877 A * 9/1991 Rogers, Jr. ..... E05B 83/24 292/110
(Continued)

FOREIGN PATENT DOCUMENTS

JP H10-115138 A 5/1998
JP 2005-163313 A 6/2005
(Continued)

*Primary Examiner* — Kristina R Fulton
*Assistant Examiner* — Faria F Ahmad
(74) *Attorney, Agent, or Firm* — Morgan, Lewis & Bockius LLP

(57) ABSTRACT

A cinching latch assembly for a vehicle may include a base plate, a first locking groove formed on the base plate by being depressed from an upper end of the base plate toward a middle hereof for insertion of a striker into the first locking groove, a first rotation shaft provided on the base plate at a first side of the first locking groove, and a safety hook rotatably combined with the first rotation shaft at a first end of the safety hook, with a hook provided at a second end of the safety hook, the hook disposed to block the first locking groove, in which when the striker is inserted into the first locking groove, the safety hook opens the first locking groove by rotating on the first rotation shaft, and blocks the first locking groove, thereby performing a first-level locking.

5 Claims, 7 Drawing Sheets

(51) Int. Cl.

| | |
|---|---|
| ***E05B 83/24*** | (2014.01) |
| ***E05B 77/12*** | (2014.01) |
| ***E05B 77/08*** | (2014.01) |
| ***E05B 81/72*** | (2014.01) |
| ***E05B 81/66*** | (2014.01) |
| ***E05B 81/68*** | (2014.01) |
| ***E05B 77/10*** | (2014.01) |

(52) U.S. Cl.
CPC ..... *E05B 77/10* (2013.01); *E05B 77/12* (2013.01); *E05B 81/66* (2013.01); *E05B 81/68* (2013.01); *E05B 81/72* (2013.01); *Y10S 292/14* (2013.01); *Y10T 292/081* (2015.04); *Y10T 292/108* (2015.04); *Y10T 292/1047* (2015.04); *Y10T 292/1082* (2015.04); *Y10T 292/1092* (2015.04)

(58) Field of Classification Search
CPC ..... E05B 81/06; E05B 81/66; E05B 81/72; E05B 81/68; E05B 83/00; Y10T 292/108; Y10T 292/1082; Y10T 292/1092; Y10T 292/1047; Y10T 292/081; Y10S 292/14; B62D 25/12
USPC ..... 292/DIG. 14
See application file for complete search history.

(56) References Cited

U.S. PATENT DOCUMENTS

| | | | | | |
|---|---|---|---|---|---|
| 5,445,421 | A * | 8/1995 | Ferrara | E05B 83/24 | 292/216 |
| 5,738,393 | A * | 4/1998 | Chao | E05B 83/24 | 292/216 |
| 5,802,894 | A * | 9/1998 | Jahrsetz | E05B 77/48 | 292/144 |
| 5,853,060 | A * | 12/1998 | Chao | E05B 83/16 | 180/69.2 |
| 5,868,444 | A * | 2/1999 | Brackmann | E05B 81/20 | 292/196 |
| 6,106,033 | A * | 8/2000 | Ruckert | E05B 83/16 | 292/216 |
| 6,168,216 | B1 * | 1/2001 | Nakajima | E05B 81/20 | 292/201 |
| 6,422,616 | B1 | 7/2002 | Wortmann et al. | | |
| 6,485,071 | B2 * | 11/2002 | Schwaiger | E05B 83/16 | 292/216 |
| 6,581,987 | B1 * | 6/2003 | Gentile | E05B 83/24 | 292/216 |
| 6,616,203 | B1 * | 9/2003 | Lenk | E05B 3/06 | 292/336.3 |
| 6,695,360 | B1 * | 2/2004 | Forsell | E05B 83/16 | 292/201 |
| 7,261,337 | B2 * | 8/2007 | Nakagome | E05B 83/24 | 292/216 |
| 8,029,030 | B2 * | 10/2011 | Shimura | B60N 2/01583 | 292/216 |
| 8,534,720 | B2 * | 9/2013 | Meyer | E05B 83/16 | 292/216 |
| 8,573,658 | B2 * | 11/2013 | Kim | B60R 21/34 | 292/201 |
| 8,579,068 | B2 * | 11/2013 | Farooq | B60R 21/38 | 180/274 |
| 8,657,348 | B2 * | 2/2014 | Coleman | E05B 85/26 | 292/198 |
| 9,187,936 | B2 * | 11/2015 | Kim | E05B 83/24 | |
| 9,255,429 | B2 * | 2/2016 | Kim | E05B 83/24 | |
| 9,534,428 | B2 * | 1/2017 | Kim | E05B 83/24 | |
| 9,611,676 | B2 * | 4/2017 | Bendel | E05B 77/06 | |
| 9,784,020 | B2 * | 10/2017 | Kwon | E05B 83/24 | |
| 9,874,046 | B2 * | 1/2018 | Wittelsbuerger | E05B 77/06 | |
| 10,035,490 | B2 * | 7/2018 | Kim | E05C 1/08 | |
| 10,145,154 | B2 * | 12/2018 | Ferri | E05B 85/26 | |
| 2004/0256861 | A1 * | 12/2004 | Nakagome | E05B 83/24 | 292/95 |
| 2006/0028029 | A1 * | 2/2006 | Spurr | E05B 81/20 | 292/216 |
| 2006/0226661 | A1 * | 10/2006 | Moore | E05B 81/20 | 292/216 |
| 2007/0046035 | A1 * | 3/2007 | Tolley | E05B 81/06 | 292/201 |
| 2007/0220934 | A1 * | 9/2007 | Chevalier | E05B 81/14 | 70/237 |
| 2007/0246944 | A1 * | 10/2007 | Sundararajan | B60R 21/38 | 292/92 |
| 2008/0217928 | A1 * | 9/2008 | Spurr | E05B 81/20 | 292/198 |
| 2008/0303291 | A1 * | 12/2008 | Spurr | E05B 81/14 | 292/216 |
| 2009/0199605 | A1 * | 8/2009 | Spurr | E05B 81/14 | 70/266 |
| 2010/0194120 | A1 * | 8/2010 | Kaiser | E05B 81/20 | 292/198 |
| 2012/0049543 | A1 * | 3/2012 | Park | E05B 83/24 | 292/220 |
| 2012/0181798 | A1 * | 7/2012 | Margheritti | E05B 77/32 | 292/200 |
| 2012/0280519 | A1 * | 11/2012 | Hong | E05B 83/24 | 292/128 |
| 2013/0049403 | A1 * | 2/2013 | Fannon | E05B 83/24 | 296/193.11 |
| 2013/0300134 | A1 * | 11/2013 | Jayasuriya | E05B 77/08 | 292/129 |
| 2014/0049056 | A1 * | 2/2014 | Scholz | E05B 81/14 | 292/200 |
| 2015/0061301 | A1 * | 3/2015 | Torka | E05B 77/36 | 292/194 |
| 2015/0145263 | A1 | 5/2015 | Farris et al. | | |
| 2016/0258194 | A1 * | 9/2016 | Rosales | E05B 77/12 | |
| 2018/0030763 | A1 * | 2/2018 | Distefano | E05B 77/54 | |
| 2018/0155965 | A1 * | 6/2018 | Estrada | E05B 81/20 | |

FOREIGN PATENT DOCUMENTS

| | | | |
|---|---|---|---|
| JP | 2010-229631 | A | 10/2010 |
| KR | 10-0728445 | B1 | 6/2007 |
| KR | 10-1560969 | B1 | 10/2015 |
| KR | 10-1566681 | B1 | 11/2015 |

* cited by examiner

CINCHING LATCH ASSEMBLY FOR VEHICLE

CROSS REFERENCE TO RELATED APPLICATION

The present application claims priority to Korean Patent Application No. 10-2016-0048530, filed Apr. 21, 2016, the entire contents of which is incorporated herein for all purposes by this reference.

BACKGROUND OF THE INVENTION

Field of the Invention

The present invention relates generally to a cinching latch used in a door, a hood, or a tailgate of a vehicle.

Description of Related Art

Generally, a vehicle is provided with the following a trunk door which when opened allows objects to be loaded into and unloaded out of a trunk, doors through which a user of the vehicle gets into and out of the vehicle, and a hood through which an engine room is accessed. Each door is provided with a latch that is engaged and disengaged with a striker.

For a hood latch of the related art installed to lock and unlock a hood, when a user of a vehicle did not apply a sufficient force to the hood so as to close the hood, many problems occurred. Even when the user did not apply a sufficient force to the hood, a striker and the hood latch were incompletely engaged with each other, though they appeared to be secured. However, due to lift occurring during high-speed driving, the hood of the vehicle abruptly opened, which caused accidents.

Additionally, although a user did not intend to open a hood of a vehicle, the hood was opened by mistake. In this case, there were cases that the user continued to drive the vehicle with the presumption that the hood had latched itself shut by virtue of its own weight.

In addition, when unlocking a hood, manipulation of a lever in a vehicle enabled only a first-level unlocking to be performed, and thus the hood latch of the related art caused discomfort in that a complete unlocking of the hood required an additional manipulation under the hood.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cinching latch assembly, whereby although a user does not apply a sufficient force to a hood so as to close the hood, the cinching latch assembly allows complete locking to be automatically performed, and allows the hood to be opened by a two-level manipulation such that the hood is not opened by a simple manipulation mistake, thereby allowing the hood to be opened by the two-level manipulation without an additional manipulation of the user.

According to various aspects of the present invention, a cinching latch assembly for a vehicle may include a base plate, a first locking groove formed on the base plate by being depressed from an upper end of the base plate toward a middle hereof for insertion of a striker into the first locking groove, a first rotation shaft provided on the base plate at a first side of the first locking groove, and a safety hook rotatably combined with the first rotation shaft at a first end of the safety hook, with a hook provided at a second end of the safety hook, the hook disposed to block the first locking groove, in which when the striker is inserted into the first locking groove, the safety hook may open the first locking groove by rotating on the first rotation shaft, and block the first locking groove, thereby performing a first-level locking.

The cinching latch assembly may further include a second rotation shaft provided on the base plate at a second side of the first locking groove, and a claw rotatably combined with the second rotation shaft at a middle of the claw, with a second locking groove provided on a first end of the claw by being depressed toward the middle of the claw to correspond to an entering position of the striker, and with a stop protrusion provided on an outer surface of a second end of the claw, in which after the striker enters the second locking groove, the claw may rotate, so that the first locking groove and the second locking groove may be positioned so as to intersect each other, thereby performing a second-level locking.

The cinching latch assembly may further include an actuator lever rotatably combined with the second rotation shaft at a first end of the cinching latch assembly, the actuator lever being rotated on the second rotation shaft by a force applied to a second end of the actuator lever, and a cinching lever rotatably combined with a middle of the actuator lever at a first end of the cinching lever, the cinching lever pushing the stop protrusion at a second end of the cinching lever by operating in conjunction with a rotation of the actuator lever, in which when the actuator lever is rotated by the force applied thereto, the cinching lever may push the stop protrusion of the claw by operating in conjunction with the rotation of the actuator lever, thereby rotating the claw.

The cinching latch assembly may further include a claw locker rotatably combined with the first rotation shaft at a first end of the claw locker, with a first stopper provided at a second end of the claw locker, in which after the claw rotates, the first end of the claw may be stopped by the first stopper, so a rotated position of the claw is locked in place.

The cinching latch assembly may further include a pawl rotatably combined with the first rotation shaft at a first end of the pawl, the pawl being rotated on the first rotation shaft by a force applied to a second end of the pawl, and an open clutch lever rotatably combined with a middle part of the pawl at a first end of the open clutch lever, with a pin provided at a second end of the open clutch lever, in which the claw locker may further include a second stopper at the second end of the claw locker, and when the open clutch lever operates in conjunction with a rotation of the pawl, the pin of the open clutch lever is stopped by the second stopper and rotates the claw locker, thereby releasing locking of the claw.

The safety hook may be provided with a stop portion at a middle of the safety hook, and when the open clutch lever operates in conjunction with the rotation of the pawl, the pin of the open clutch lever may be stopped by the stop portion and rotate the safety hook, thereby releasing locking of the safety hook.

As mentioned above, according to the cinching latch assembly of various embodiments of the present invention, although a user does not apply a sufficient force to a hood so as to close the hood, the cinching latch assembly allows complete locking to be automatically performed, and allows the hood to be opened by a two-level manipulation such that the hood is not opened by a simple mistake in manipulation, thereby preventing accidents due to incomplete locking of the hood.

In addition, the cinching latch assembly enables a two-level locked state to be completely released by the two-level manipulation of a lever in a vehicle, thereby not requiring an additional manipulation for opening the hood.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
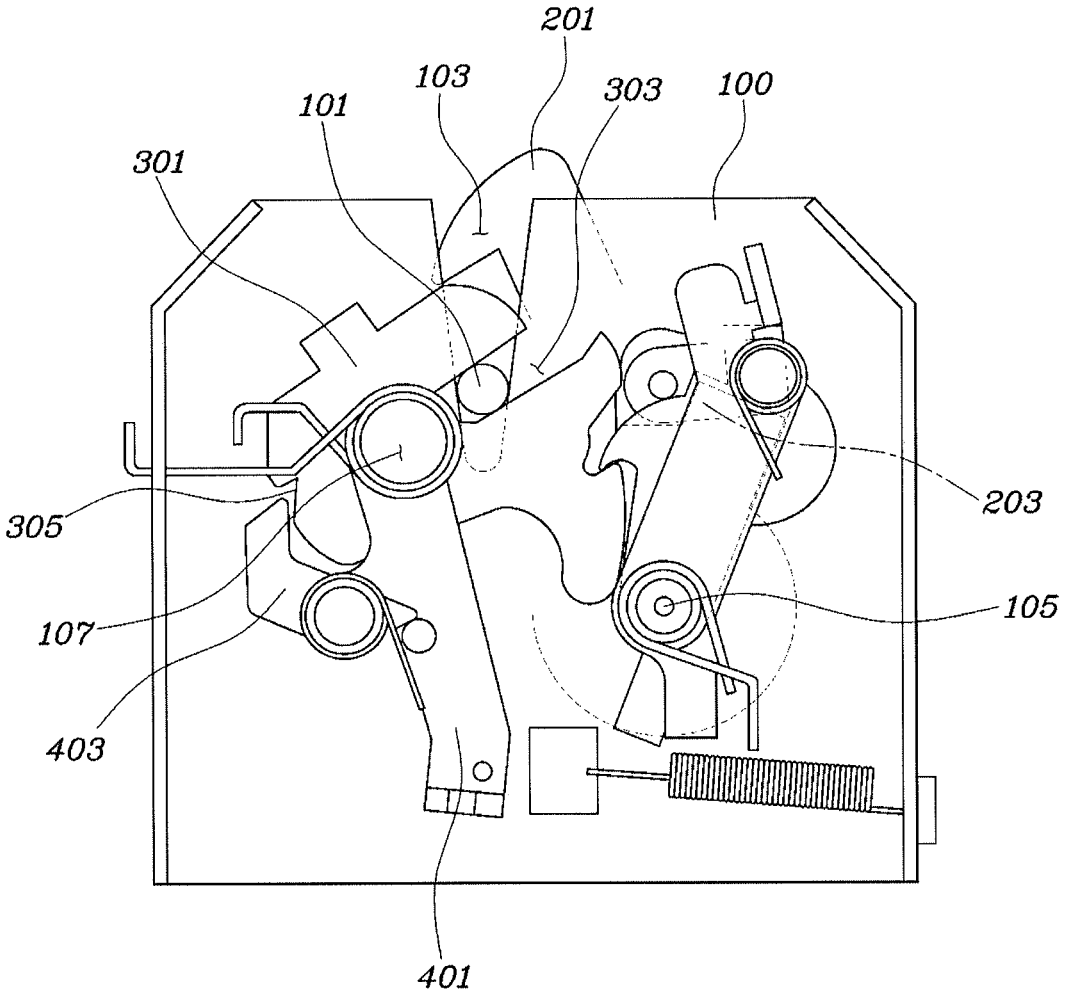
FIG. 1 is a top plan view showing a cinching latch assembly for a vehicle according to various embodiments of the present invention.
Figure 2A:
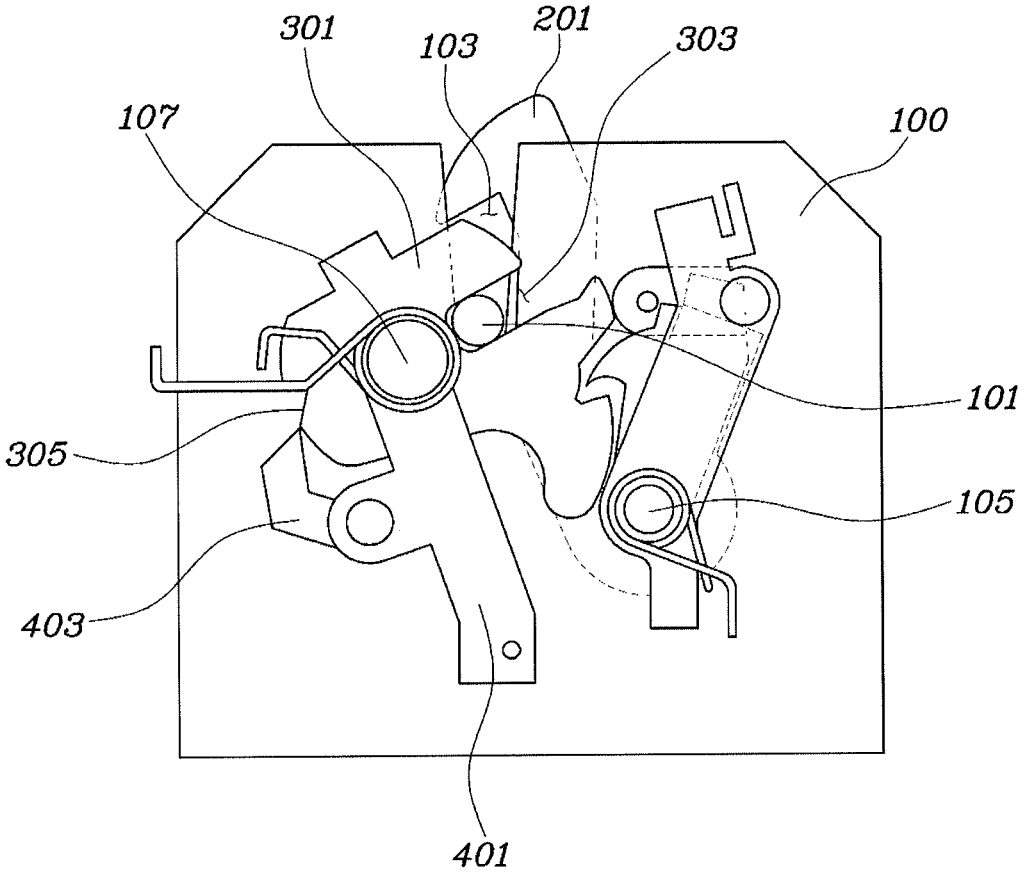
FIG. 2A and FIG. 2B are top plan views showing locking operation processes of the cinching latch assembly for a vehicle according to various embodiments of the present invention.
Figure 2B:
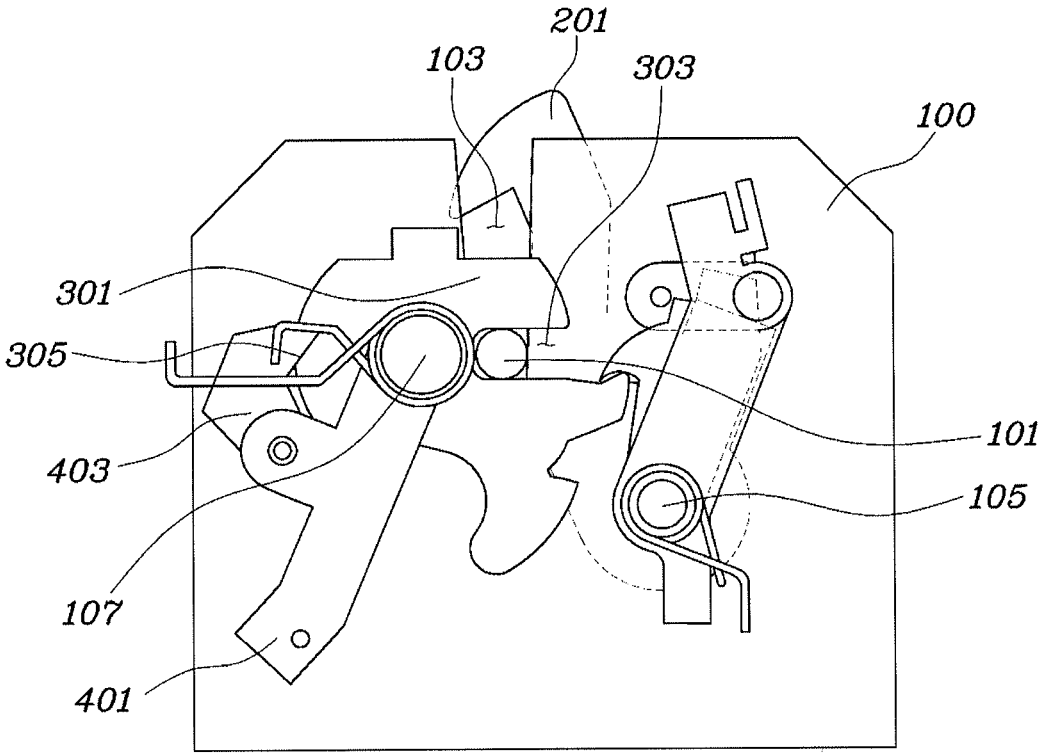
Figure 3A:
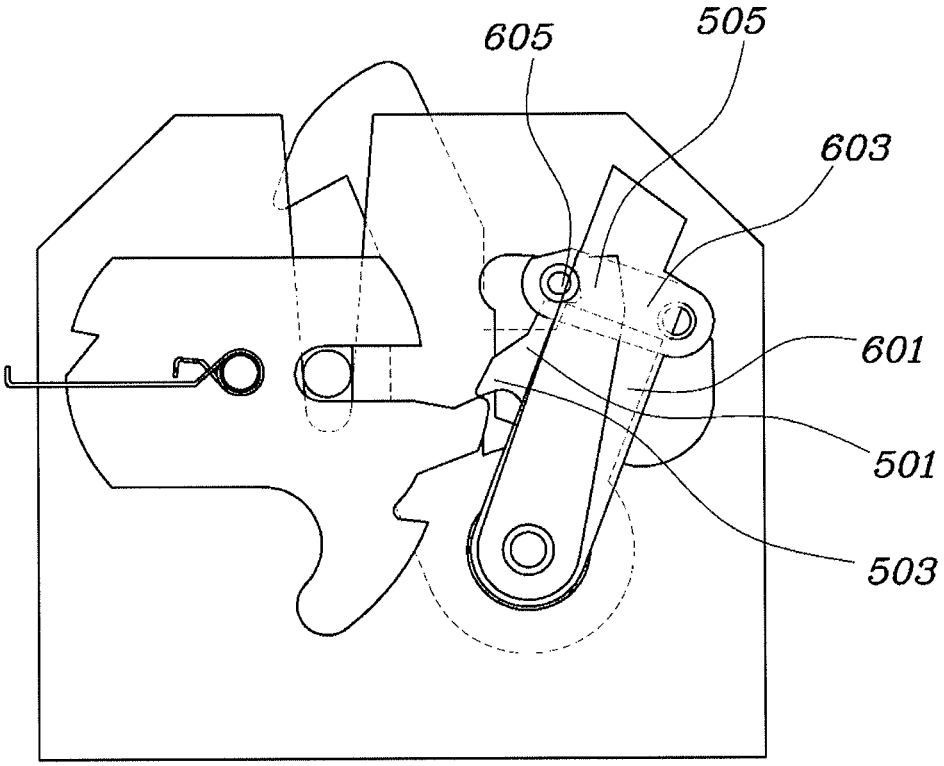
FIG. 3A, FIG. 3B, FIG. 3C, and FIG. 3D are top plan views showing unlocking operation processes of the cinching latch assembly for a vehicle according to various embodiments of the present invention.
Figure 3B:
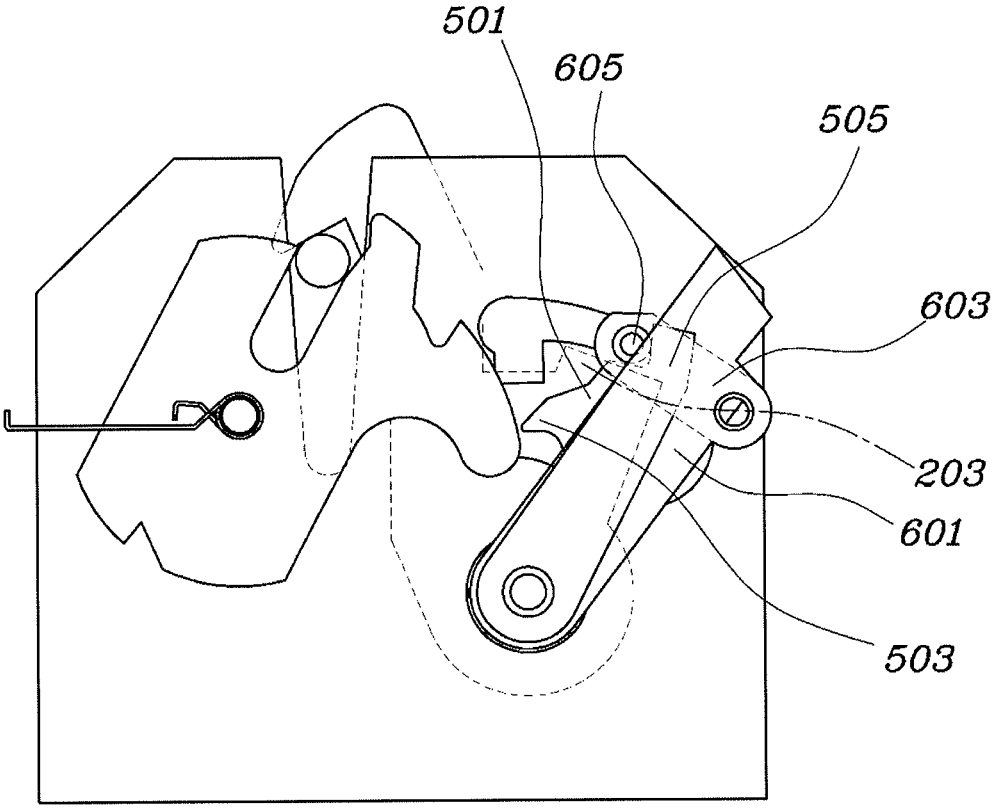
Figure 3C:
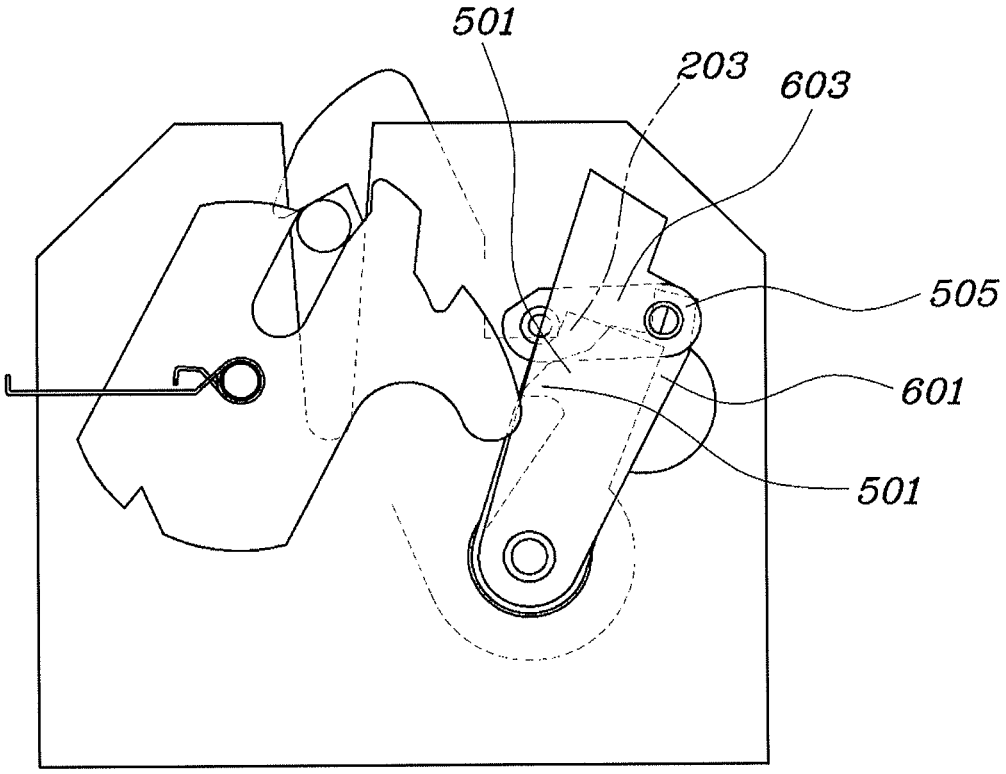
Figure 3D:
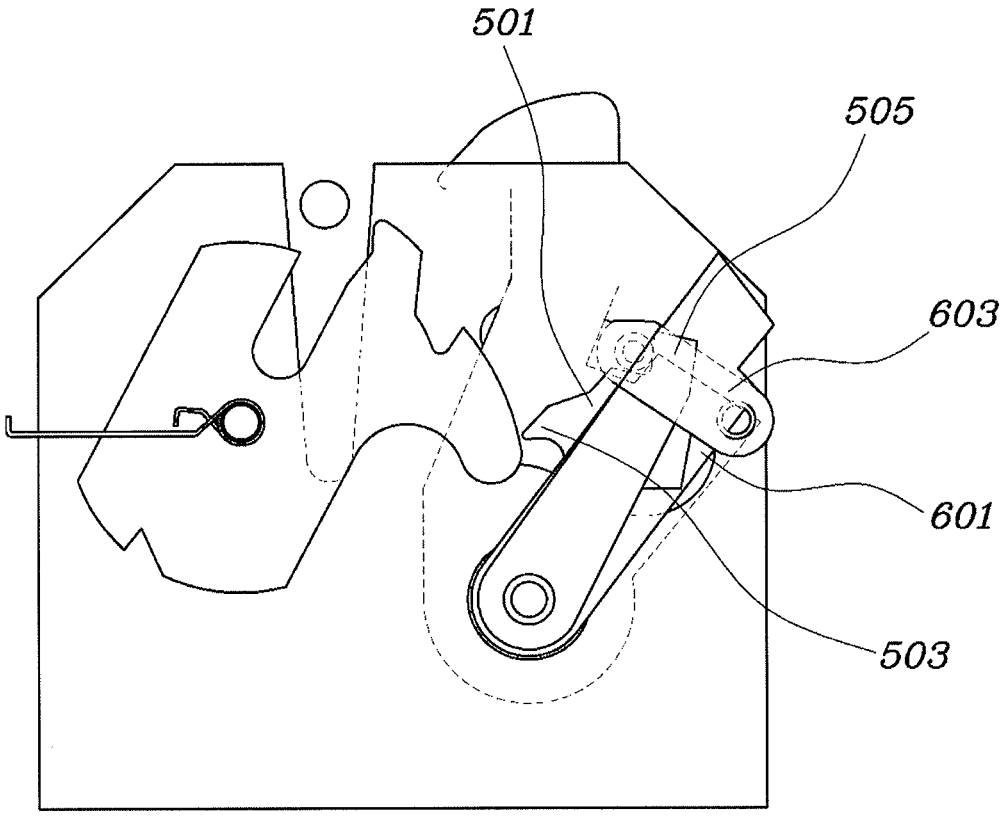

FIG. 1 is a top plan view showing a cinching latch assembly for a vehicle according to various embodiments of the present invention. FIGS. 2A and 2B are top plan views showing locking operation processes of the cinching latch assembly for a vehicle according to various embodiments of the present invention. FIGS. 3A to 3D are top plan views showing unlocking operation processes of the cinching latch assembly for a vehicle according to various embodiments of the present invention.

A cinching latch assembly for a vehicle according to various embodiments of the present invention includes a base plate 100, a first locking groove 103 formed on the base plate 100 by being depressed from an upper end of the base plate 100 toward a middle thereof such that a striker 101 is inserted into the first locking groove 103, a first rotation shaft 105 provided on the base plate 100 at a first side of the first locking groove 103, and a safety hook 201 rotatably combined with the first rotation shaft 105 at a first end thereof, with a hook provided at a second end of the safety hook 201, the hook being disposed so as to block the first locking groove 103, wherein when the striker 101 is inserted into the first locking groove 103, the safety hook 201 opens the first locking groove 103 by rotating on the first rotation shaft 105, and blocks the first locking groove 103, thereby performing a first-level locking.

The cinching latch assembly may further include: a second rotation shaft 107 provided on the base plate 100 at a second side of the first locking groove 103, and a claw 301 rotatably combined with the second rotation shaft 107 at a middle thereof, with a second locking groove 303 provided on a first end of the claw 301 by being depressed toward the middle of the claw 301 so as to correspond to an entering position of the striker 101, and with a stop protrusion 305 provided on an outer surface of a second end of the claw 301, wherein after the striker 101 enters the second locking groove 303, the claw 301 may rotate, so that the first locking groove 103 and the second locking groove 303 may be positioned so as to intersect each other, thereby performing a second-level locking.

The cinching latch assembly may further include: an actuator lever 401 rotatably combined with the second rotation shaft 107 at a first end thereof, the actuator lever being rotated on the second rotation shaft 107 by a force applied to a second end of the actuator lever 401, and a cinching lever 403 rotatably combined with a middle of the actuator lever 401 at a first end of the cinching lever 403, the cinching lever 403 pushing the stop protrusion 305 at a second end of the cinching lever 403 by operating in conjunction with a rotation of the actuator lever 401, in which when the actuator lever 401 is rotated by an external force applied thereto, the cinching lever 403 may push the stop protrusion 305 of the claw 301 by operating in conjunction with the rotation of the actuator lever 401, thereby rotating the claw 301.

Referring to FIG. 1 showing a configuration of the cinching latch assembly according to the present invention, the first locking groove 103 is formed on the base plate 100 by being depressed from the upper end of the base plate 100 toward the middle thereof such that the striker 101 is inserted into the first locking groove 103, and the first rotation shaft 105 is provided on the base plate 100 at the first side of the first locking groove 103. The safety hook 201 provided for locking the striker 101 at a first level by enclosing the striker 101 is rotatably combined with the first rotation shaft 105 at the first end thereof, with the hook provided at the second end of the safety hook 201, the hook being disposed so as to block the first locking groove 103.

The second rotation shaft 107 is provided on the base plate 100 at a second side of the first locking groove 103, and the claw 301 provided for locking the striker 101 at a second level is rotatably combined with the second rotation shaft 107 at a middle thereof, with the second locking groove 303 provided at a first end of the claw by being depressed toward the middle of the claw 301. Further, an entrance of the second locking groove 303 is disposed so as to overlap the first locking groove 103, and the second locking groove 303 is provided so as to correspond to an entering position of the striker 101 such that the striker 101 is also inserted into the second locking groove 303 when the striker 101 is inserted into the first locking groove 103. The claw 301 is provided with the stop protrusion 305 on the outer surface of the second end thereof, and the claw 301 is provided with an elastic body such as a torsion spring combined therewith such that the claw 301 rotates in a direction opening the first locking groove 103.

The actuator lever 401 is rotatably combined with the second rotation shaft 107 at a first end thereof, and the actuator lever 401 is disposed so as to be rotated on the second rotation shaft 107 by a force applied to a second end of the actuator lever by a motor connected thereto via a cable. The cinching lever 403 transmitting a rotational force such that the claw 301 rotates so as to apply the second-level locking to the striker 101 is rotatably combined with a middle of the actuator lever 401 at a first end thereof, and the cinching lever 403 is configured to push the stop protrusion 305 at a second end thereof by operating in conjunction with the rotation of the actuator lever 401.

Referring to FIGS. 2A and 2B showing two-level locking operation processes of the cinching latch, while a hood is closed, the striker 101 mounted to the hood comes into contact with an upper end of the hook of the safety hook 201 in the cinching latch assembly. In this case, the safety hook 201 is pushed by an inclining surface of the hook, and while the safety hook 201 rotates on the first rotation shaft 105, the first locking groove 103 is opened. While the striker 101 is inserted into the first locking groove 103, the striker 101 is inserted into the second locking groove 303 of the claw 301 which the first locking groove 103 partially overlaps. In this case, when a second end of the actuator lever 401 is pulled, the actuator lever 401 is rotated on the second rotation shaft 107, and the cinching lever 403 connected to a middle of the actuator lever 401 pushes the stop protrusion 305 of the claw 301, and thus the claw 301 is rotated. In this case, the first locking groove 103 and the second locking groove 303 intersect with each other, and the striker 101 is positioned at the intersection position, thereby performing the second-level locking.

Accordingly, although a user does not apply a sufficient force to a hood, the cinching latch assembly allows the two-level locking to be automatically performed, thereby preventing accidents due to the hood opening during driving.

The cinching latch assembly may further include a claw locker 501 rotatably combined with the first rotation shaft 105 at a first end thereof, with a first stopper 503 provided at a second end of the claw locker 501, wherein after the claw 301 rotates, the first end of the claw 301 is stopped by the first stopper 503, so the rotated position of the claw 301 is locked.

Referring to FIGS. 2A and 2B, after the second-level locking starts, the claw 301 rotates, and the first end of the claw 301 is stopped by the first stopper 503 of the claw locker 501 such that the first locking groove 103 and the second locking groove 303 remain in an intersecting state with each other. Accordingly, a hood is prevented from being opened irrespective of intention of a user.

The cinching latch assembly may further include a pawl 601 rotatably combined with the first rotation shaft 105 at a first end thereof, the pawl being rotated on the first rotation shaft 105 by a force applied to a second end of the pawl 601, and an open clutch lever 603 rotatably combined with a middle of the pawl 601 at a first end thereof, with a pin 605 provided at a second end of the open clutch lever, wherein the claw locker 501 is further provided with a second stopper 505 at the second end thereof, and when the open clutch lever 603 operates in conjunction with a rotation of the pawl 601, the pin 605 of the open clutch lever 603 is stopped by the second stopper 505 and rotates the claw locker 501, thereby releasing locking of the claw 301. Accordingly, a hood is unlocked at a first level.

The safety hook 201 may be provided with a stop portion 203 at a middle thereof, and when the open clutch lever 603 operates in conjunction with the rotation of the pawl 601, the pin 605 of the open clutch lever 603 may be stopped by the stop portion 203 and rotate the safety hook 201, thereby releasing locking of the safety hook 201. Accordingly, hood unlocking is completed.

The pawl 601 is rotatably combined with the first rotation shaft 105 at the first end thereof, the pawl being rotated on the first rotation shaft 105 by a force applied to the second end of the pawl 601; and the open clutch lever 603 is rotatably combined with the middle of the pawl 601 at the first end thereof, with the pin 605 provided at the second end of the open clutch lever 603. The pawl 601 is provided with an elastic body such as a torsion spring combined therewith such that the pawl 601 rotates in a direction toward the claw 301.

Referring to FIGS. 3A to 3D showing two-level unlocking operation processes for opening the hood, when a force is applied to a second end of the pawl 601 by an intention of a user to open the hood, the pawl 601 rotates on the first rotation shaft 105, and the open clutch lever 603 combined with the middle of the pawl 601 operates in conjunction with the pawl 601. In this case, the pin 605 provided at the second end of the open clutch lever 603 is stopped by the second stopper 505 of the claw locker 501, and pulls the second stopper 505, and the claw 301 is rotated by a force of the elastic body such as a torsion spring, thereby releasing locking of the claw 301 at the first level. After that, when a force is applied to the second end of the pawl 601 once again, the open clutch lever 603 operates in conjunction with the pawl 601, is stopped by the stop portion 203 of the safety hook 201, and pulls the stop portion 203, thereby releasing the locking of the safety hook 201 at a second level. Accordingly, the hood becomes capable of being opened.

Accordingly, opening a hood via a two-level manipulation does not allow the hood to be immediately opened despite carelessness or a mistaken hood-opening manipulation by a user, thereby preventing accidents due to the hood opening during driving.

In addition, it becomes possible to easily open a hood without an additional manipulation. As for the related art, when opening a hood via a lever in a vehicle, only a first-level unlocking was performed, and thus a complete unlocking of the hood required an additional manipulation in which a user puts his or her hands under the hood, pushes the safety hook 201, and opens the hood.

However, according to various embodiments of the present invention, when a lever is pulled one time, the locking of the claw 301 is released at the first level, and when the lever is pulled one more time, the locking of the safety hook 201 is released, thereby opening the hood completely without an additional manipulation of a user.

Accordingly, the cinching latch assembly according to various embodiments of the present invention can prevent accidents that may occur due to manipulation of a user in which the user puts his or her hands into a narrow space under the hood.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cinching latch assembly for a vehicle, the cinching latch assembly comprising:

a base plate;

a first locking groove formed on the base plate by being depressed from an upper end of the base plate toward a middle hereof for insertion of a striker into the first locking groove;

a first rotation shaft provided on the base plate at a first side of the first locking groove;

a safety hook rotatably combined with the first rotation shaft at a first end of the safety hook, with a hook provided at a second end of the safety hook, the hook disposed to block the first locking groove;

a second rotation shaft provided on the base plate at a second side of the first locking groove;

a claw combined with the second rotation shaft to be rotatable about the second rotation shaft at a middle of the claw, with a second locking groove provided on a first end of the claw by being depressed toward the middle of the claw to correspond to an entering position of the striker, and with a stop protrusion provided on an outer surface of a second end of the claw;

a claw locker combined with the first rotation shaft to be rotatable about the first rotation shaft at a first end of the claw locker and including a first stopper provided at a second end of the claw locker to be in direct contact with the claw selectively, wherein when the striker is inserted into the first locking groove, the safety hook opens the first locking groove by rotating on the first rotation shaft, and blocks the first locking groove, thereby performing a first-level locking;

an actuator lever rotatably combined with the second rotation shaft at a first end of the actuator lever, the actuator lever being rotated on the second rotation shaft by a force applied to a second end of the actuator lever; and a cinching lever rotatably combined with a middle of the actuator lever at a first end of the cinching lever, the cinching lever pushing the stop protrusion at a second end of the cinching lever by operating in conjunction with a rotation of the actuator lever, wherein when the actuator lever is rotated by the force applied thereto, the cinching lever pushes the stop protrusion of the claw by operating in conjunction with the rotation of the actuator lever, thereby rotating the claw.

2. The cinching latch assembly of claim 1, wherein after the striker enters the second locking groove, the claw rotates, thereby performing a second-level locking.

3. The cinching latch assembly of claim 2, wherein after the claw rotates, the first end of the claw is stopped by the first stopper, so a rotated position of the claw is locked in place.

4. The cinching latch assembly of claim 3, further comprising:

a pawl rotatably combined with the first rotation shaft at a first end of the pawl, the pawl being rotated on the first rotation shaft by a force applied to a second end of the pawl; and an open clutch lever rotatably combined with a middle of the pawl at a first end of the open clutch lever, with a pin provided at a second end of the open clutch lever, wherein the claw locker further includes a second stopper at the second end of the claw locker, and when the open clutch lever operates in conjunction with a rotation of the pawl, the pin of the open clutch lever is stopped by the second stopper and rotates the claw locker, thereby releasing locking of the claw.

5. The cinching latch assembly of claim 4, wherein the safety hook is provided with a stop portion at a middle of the safety hook; and when the open clutch lever operates in conjunction with the rotation of the pawl, the pin of the open clutch lever is stopped by the stop portion and rotates the safety hook, thereby releasing locking of the safety hook.

* * * * *